US006552644B2

(12) United States Patent
Yu

(10) Patent No.: US 6,552,644 B2
(45) Date of Patent: Apr. 22, 2003

(54) SAFETY PRESS-BUTTON SWITCH

(76) Inventor: Tsung-Mou Yu, 4, Sublane 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 86 days.

(21) Appl. No.: 09/906,048

(22) Filed: Jul. 17, 2001

(65) Prior Publication Data

US 2003/0016115 A1 Jan. 23, 2003

(51) Int. Cl.[7] ..... H01H 71/16; H01H 3/00; H01H 37/02; H01H 37/32

(52) U.S. Cl. ..... 337/66; 337/61; 337/60; 337/59; 337/37; 200/277.1; 200/277.2; 200/332; 200/341

(58) Field of Search ..... 337/66, 58, 59, 337/61, 60, 37, 1, 3, 12, 13, 14, 16, 112, 113, 140, 333–335, 345, 379; 200/553, 237, 277.1, 277.2, 276.1, 332, 341

(56) References Cited

U.S. PATENT DOCUMENTS

| | | | | | |
|---|---|---|---|---|---|
| 2,476,648 | A | * | 7/1949 | Zeller | 337/69 |
| 2,516,670 | A | * | 7/1950 | Bourne | 337/53 |
| 3,469,222 | A | * | 9/1969 | Brackett, Sr. | 337/74 |
| 3,706,057 | A | * | 12/1972 | Ellenberger | 335/23 |
| 4,068,203 | A | * | 1/1978 | Unger | 337/56 |
| 4,682,138 | A | * | 7/1987 | Sell | 337/68 |
| 4,780,697 | A | * | 10/1988 | Cobb et al. | 337/70 |
| 4,812,799 | A | * | 3/1989 | Cobb et al. | 337/70 |
| 5,079,530 | A | * | 1/1992 | Tsuchiyama | 335/17 |
| 5,264,817 | A | * | 11/1993 | Sorenson | 337/68 |
| 5,453,725 | A | * | 9/1995 | You et al. | 337/68 |
| 5,889,457 | A | * | 3/1999 | Hsu et al. | 337/59 |
| 5,898,355 | A | * | 4/1999 | Yu | 337/8 |
| 5,936,505 | A | * | 8/1999 | Yu | 337/66 |
| 6,121,868 | A | * | 9/2000 | Chiang | 337/37 |
| 6,445,273 | B1 | * | 9/2002 | Yu | 337/37 |
| 6,448,880 | B2 | * | 9/2002 | Yu | 337/66 |
| 6,456,185 | B1 | * | 9/2002 | Yu | 337/37 |
| 6,480,079 | B1 | * | 11/2002 | Bentley et al. | 335/6 |
| 6,483,416 | B2 | * | 11/2002 | Yu | 337/126 |

FOREIGN PATENT DOCUMENTS

| | | | | | |
|---|---|---|---|---|---|
| DE | 2704008 | A | * | 8/1977 | H01H/5/77 |
| EP | 285340 | A2 | * | 10/1988 | H01H/73/30 |

* cited by examiner

*Primary Examiner*—Anatoly Vortman
(74) *Attorney, Agent, or Firm*—Rosenberg, Klein & Lee

(57) ABSTRACT

A safety press-button switch includes a linkage formed of a lever and a switching rod pivoted together, and a press-button cap having a push rod and a hook arm respectively aimed at the switching rod and a positioning rod of the lever and adapted to force the lever to shift a bimetal plate from OFF position to ON position and to hold the lever in position after the bimetal plate switched on, the positioning rod of the lever being forced away from the hook arm by the deformation force of the bimetal plate for enabling the bimetal plate to trip off automatically upon an overload.

6 Claims, 13 Drawing Sheets

SAFETY PRESS-BUTTON SWITCH

BACKGROUND OF THE INVENTION

The present invention relates to electric switches and, more particularly, to a safety press-button switch, which uses a linkage to control on/off switching of a bimetal plate, enabling the bimetal plate to automatically trip off upon an overload.

A variety of power switches are known for controlling on/off of power supply. Earlier power switches are seesaw switches, having ON/OFF function only. A seesaw switch does not trip off automatically upon an overload. FIGS. 1A and 1B show a seesaw switch according to the prior art. This structure of seesaw switch 1 comprises a cap-like switching lever 11 balanced on a support at its center and controlled to move a switching metal contact plate 12 between ON position and OFF position. The switching metal contact plate 12 automatically trips off upon an overload.

FIGS. 2A and 2B show a press-button type safety switch according to the prior art. This structure of safety switch comprises a housing 21, a press-button 22 supported on a spring 27, an actuating block 23 connected to the press-button 22, the actuating block 23 having a heart-shaped locating groove 24 at the right side, a bimetal plate 26 fastened to a right-sided power terminal 25, the bimetal plate 26 having a top pin 27 adapted to engage the locating groove 24. When pressing the press-button 22, the locating groove 24 of the actuating block 23 is forced into engagement with the top pin 261 of the bimetal plate 26 to close the circuit. In case of heat is produced and transmitted from the right-sided terminal 25 to the bimetal plate 26 due to an overload, the bimetal plate 26 is deformed to disengage the top pin 261 from the locating groove 24 of the actuating block 23, and the spring 27 immediately forces the press-button 22 upwards to OFF position. However, this structure of safety switch is still not satisfactory in function. When the metal contact holder 29 is lowered with the press-button 22 to force its contacts 291;292 into contact with the contact 281 of the middle terminal 28 and the contact 251 of the right-sided terminal 25, electric current is not connected to the bimetal plate 26, and the bimetal plate 26 is not directly sensitive to the electric current. When a short-circuit high temperature is produced, it is transmitted from the metal contact holder 29 to the right-sided terminal 25, and then transmitted from the right-sided terminal 25 to the bimetal plate 26. Because the transmission of heat from the metal contact holder to the bimetal plate 26 takes much time, the bimetal plate 26 does not trip off immediately upon an overload. Further, the four-contact (281;291;292;251) design is complicated. There are also known other similar safety press-button switches that automatically trip off upon an overload. However, these conventional safety press-button switches are commonly complicated, and expensive. In case one element fails, the actuating metal contact plate cannot trip off automatically upon an overload.

SUMMARY OF THE INVENTION

The present invention has been accomplished to provide a safety press-button switch, which eliminates the aforesaid drawbacks. It is one object of the present invention to provide a safety press-button switch, which uses a reversible linkage to control on/off status of a bimetal plate, enabling the bimetal plate to trip off automatically upon an overload. It is another object of the present invention to provide a linkage for a safety press-button switch, which fits any of a variety of on/off switching metal contact plates. It is still another object of the present invention to provide a safety press-button switch is easy to install and, durable in use. According to one aspect of the present invention, the safety press-button switch comprises a linkage formed of a lever and a switching rod pivoted together, and a press-button cap having a push rod and a hook arm respectively aimed at the switching rod and a positioning rod of the lever and adapted to force the lever to shift an actuating metal contact plate from OFF position to ON position and to hold the lever in position after the actuating metal contact plate switched on, the positioning rod of the lever being forced away from the hook arm by the deformation force of the bimetal plate for enabling the actuating metal contact plate to trip off automatically upon an overload. According to another aspect of the present invention, the actuating metal contact plate is a bimetal plate.

DETAILED DESCRIPTION OF THE PREFERRED EMBODIMENT

Figure 1A:
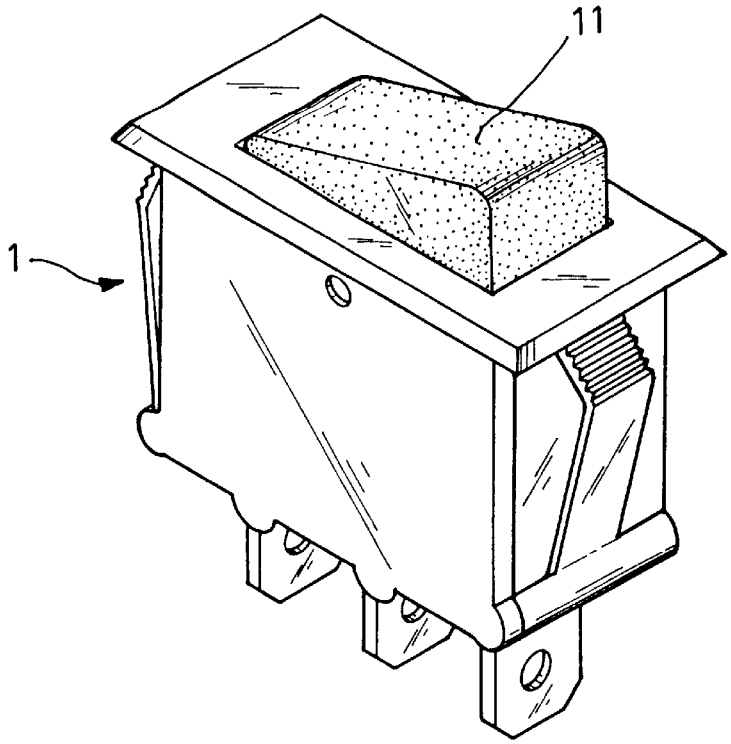
FIG.1(A) PRIOR ART
FIG. 1A is an elevational view of a seesaw switch according to the prior art.
Figure 1:
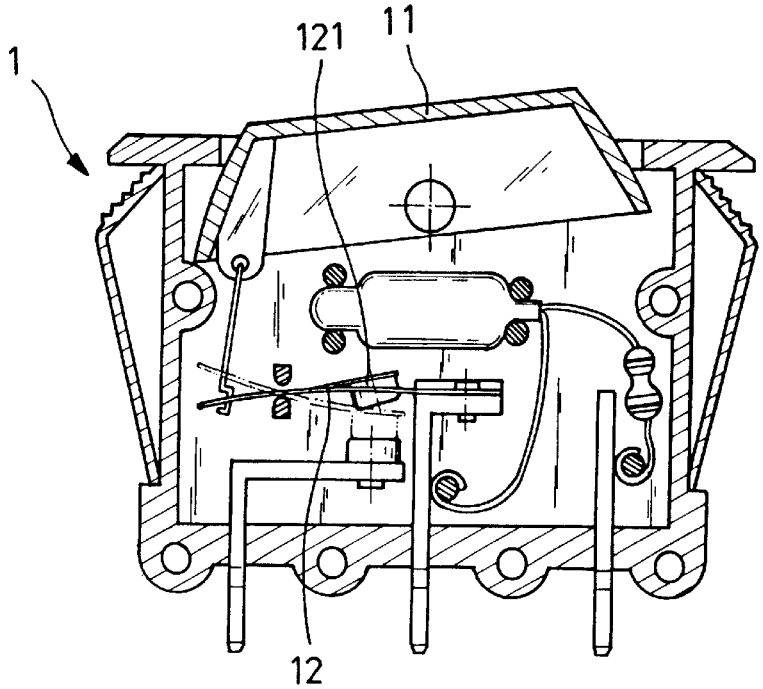
FIG.1 (B) PRIOR ART
FIG. 1B is a sectional view of the seesaw switch shown in FIG. 1.
Figure 2A:
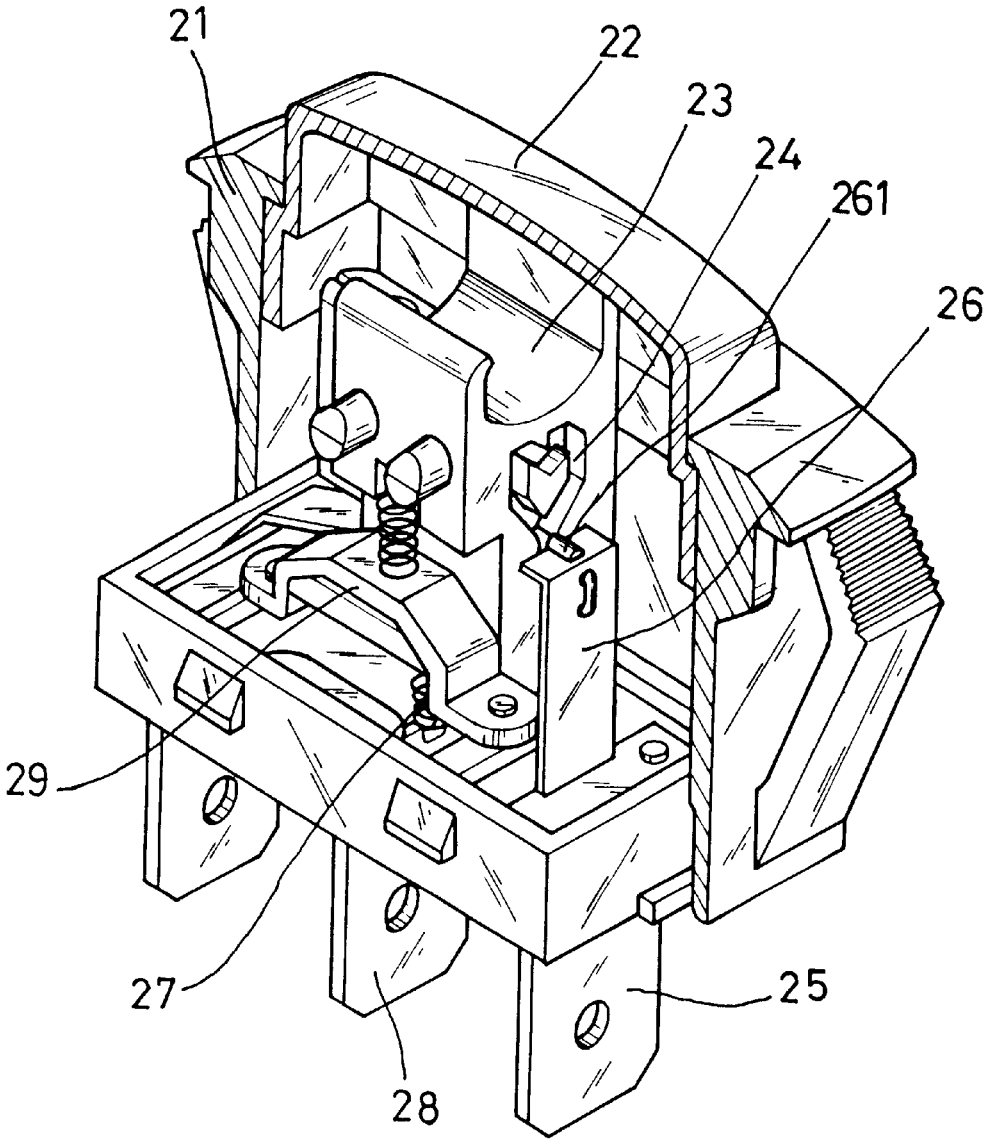
FIG. 2(A) PRIOR ART
FIG. 2A is a cutaway view of a press-button switch according to the prior art.
Figure 2B:
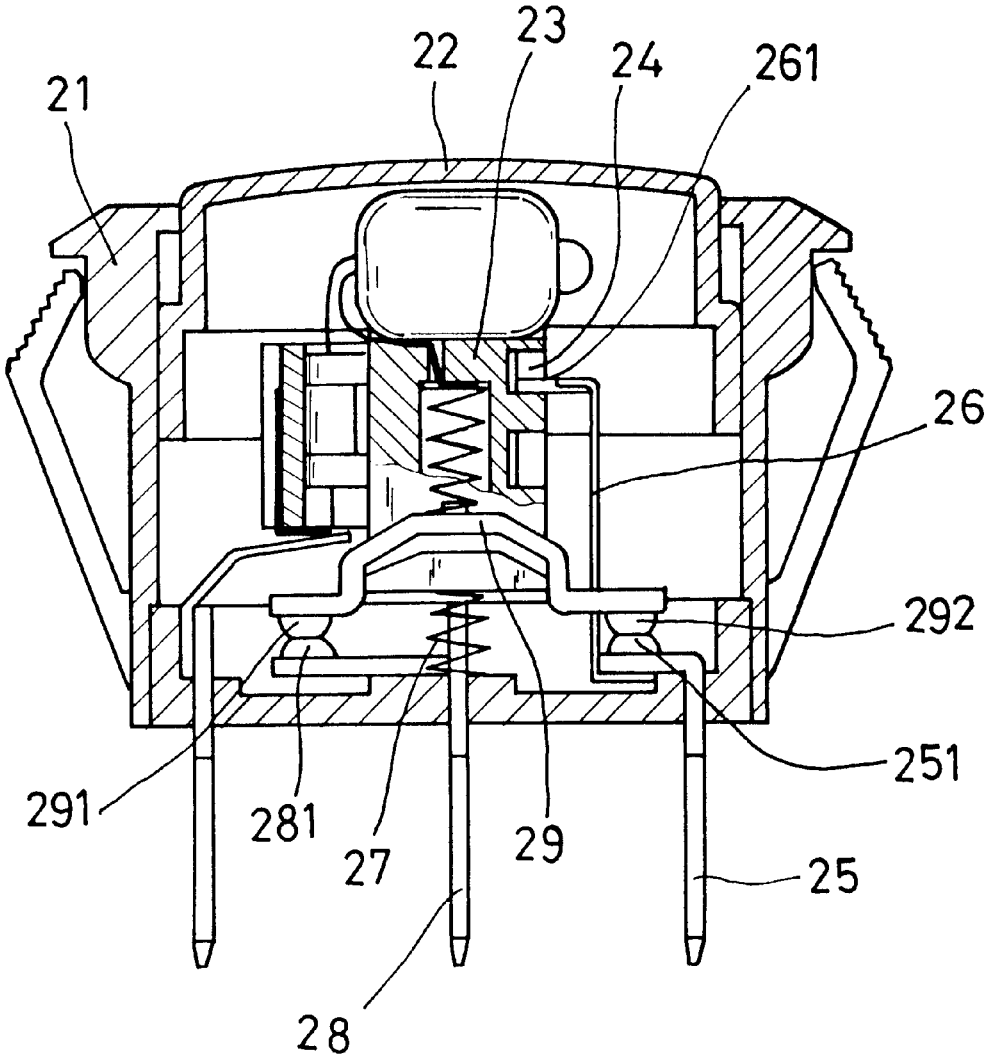
FIG. 2(B) PRIOR ART
FIG. 2B is a sectional view of the press-button switch shown in FIG. 2A.
Figure 3:
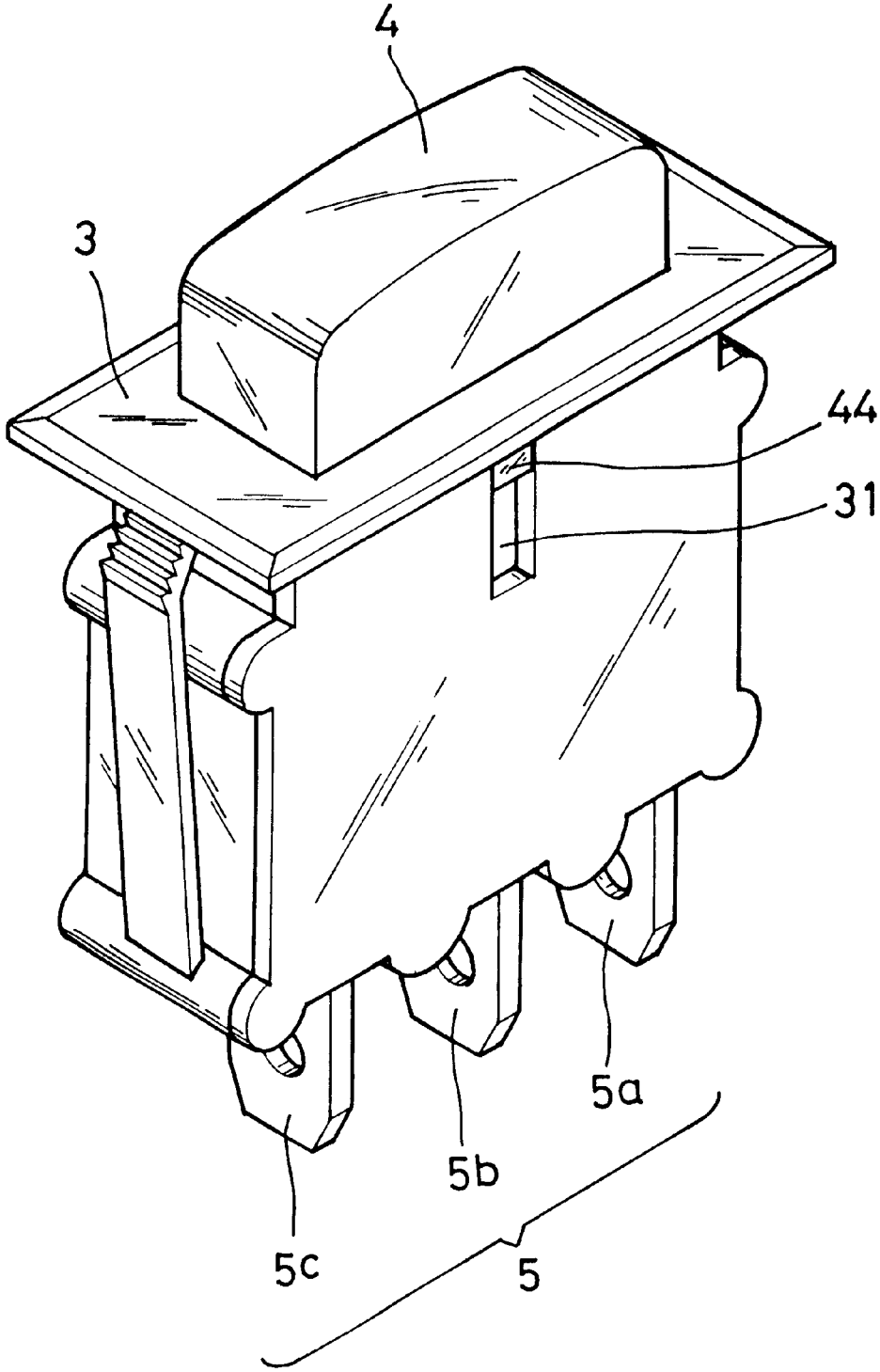
FIG. 3 is an elevational view of a safety press-button switch according to the present invention.
Figure 4:
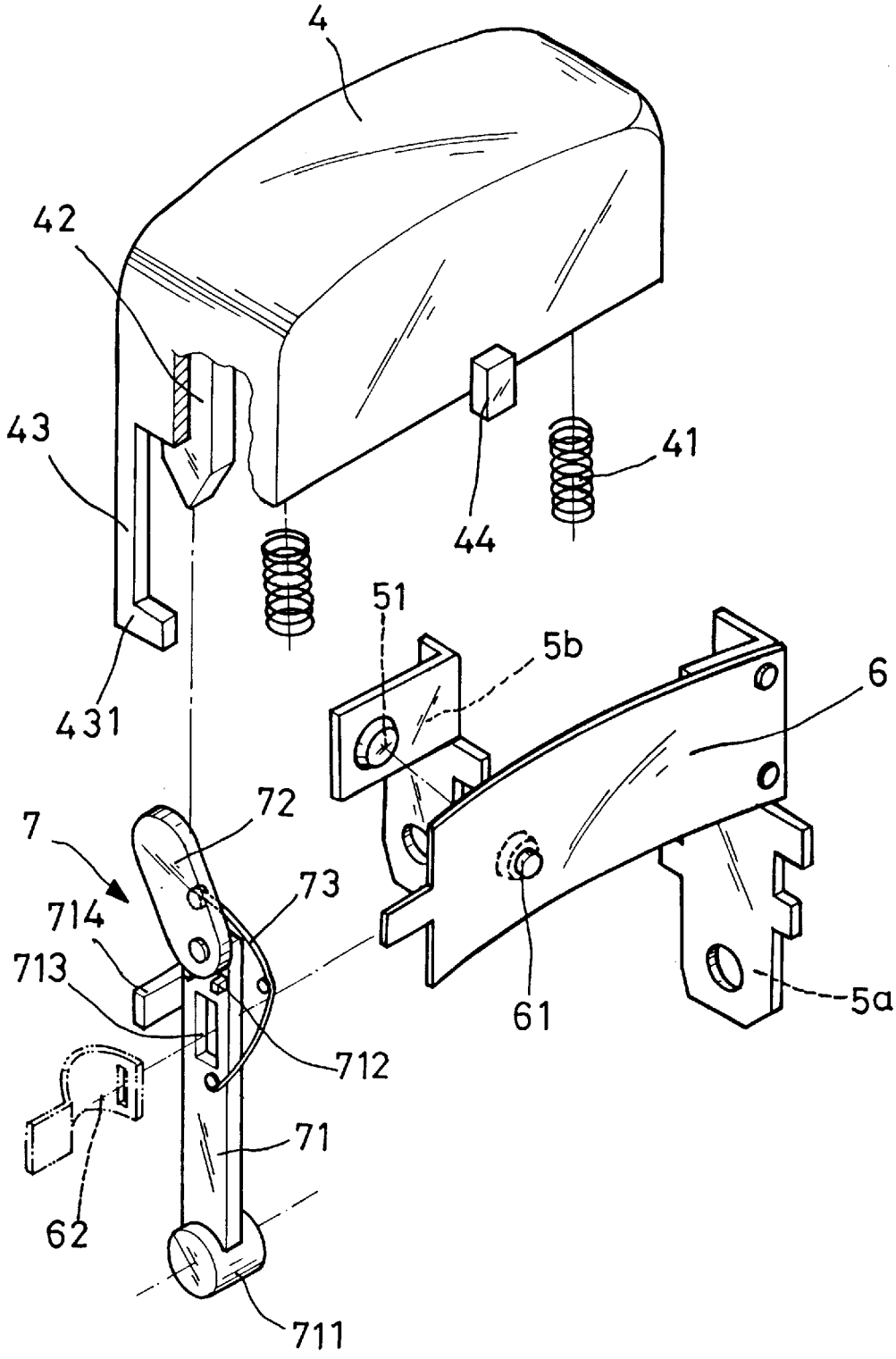
FIG. 4 is an exploded view of a part of the safety press-button switch according to the present invention.
Figure 5:
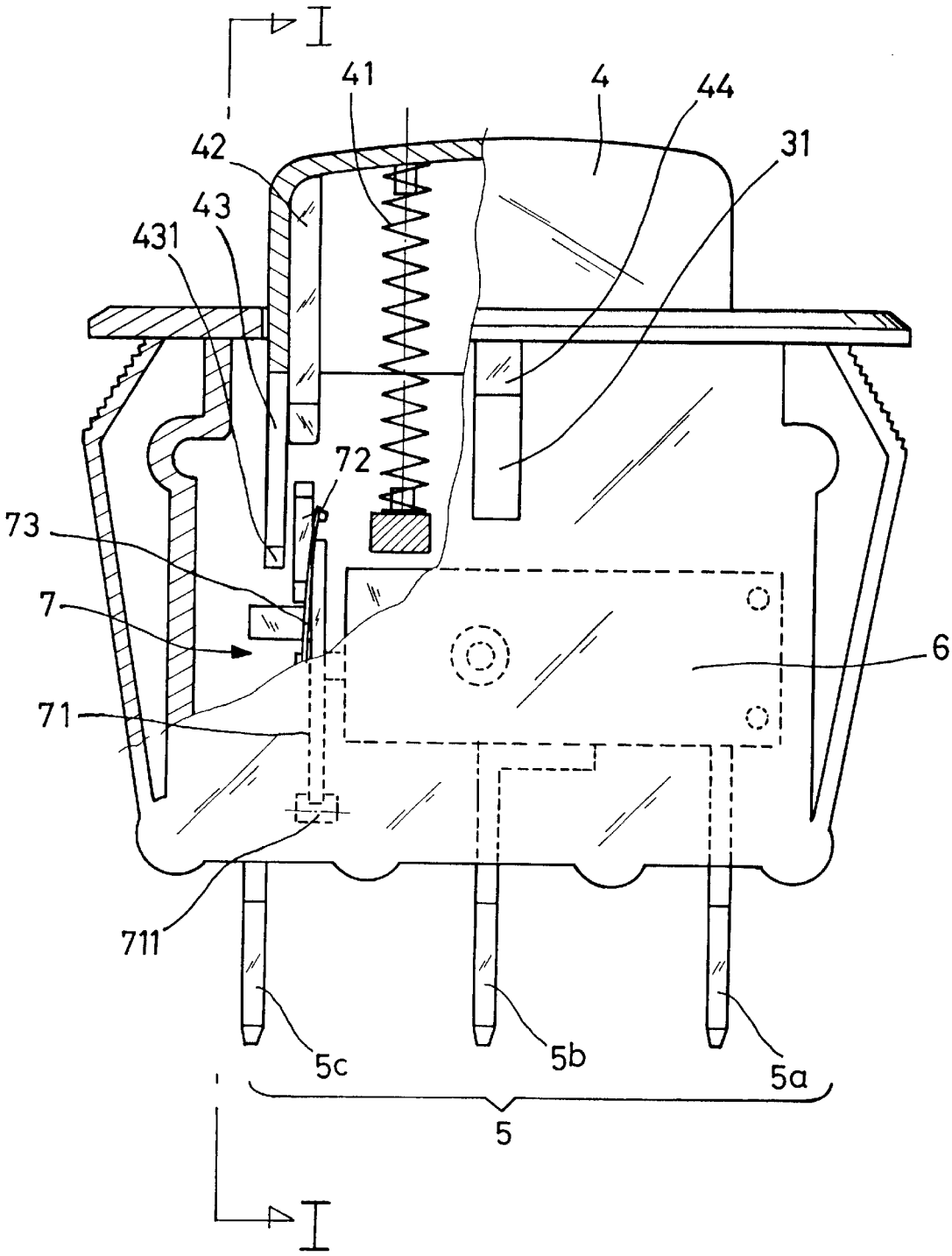
FIG. 5 is a side view in section of the safety press-button switch according to the present invention.

Referring to FIGS. From 3 through 5, a safety press-button switch in accordance with the present invention is generally comprised of an electrically insulative housing 3, a press-button cap 4, a plurality of metal terminals 5, an actuating metal contact plate, for example, a bimetal plate 6, and a linkage 7. The housing 3 is a hollow box. The press-button cap 4 is mounted in the top side of the housing 3 and supported on return springs 41, having a guide block 44 disposed at one side thereof. Further, the press-button cap 4 admits light, and serves also as a lampshade for an indicator light. The housing 3 has a longitudinal sliding slot 31 disposed at one side, which receives the guide block 44 to guide movement of the press-button cap 4 in longitudinal direction. The electric terminals 5 includes a first terminal 5*a* connected to the bimetal plate 6, a second terminal 5*b* having a contact 51, and a third terminal 5*c* for grounding. The bimetal plate 6 has a contact 61 corresponding to the contact 51 of the second terminal 5*b*. The linkage 7 is controlled by the press-button cap 4 to move the bimetal plate 6 between ON and OFF positions.

The main features of the present invention are outlined hereinafter. The linkage 7 is mounted in one side inside the housing 3 comprising a lever 71, a switching rod 72, and a spring member 73. The lever 71 has a round rod 711 transversely disposed at a first end thereof and pivoted to the housing 3 for enabling the lever 71 to be turned back and forth, two stop rods 712 bilaterally disposed near the second end thereof and adapted to limit the turning angle of the lever 71, a positioning rod 714 disposed at one side adjacent to the stop rods 712 for positioning, and a retaining portion 713 disposed near the second end and equally spaced from the stop rods 712 and adapted to move the bimetal plate 6. The switching rod 72 has a bottom end pivoted to the second end of the lever 71 between the stop rods 712. Due to the effect of the stop rods 712, the left-right turning angle of the switching rod 72 is limited to a fixed range upon movement of the lever 71. The spring member 73 is connected between the lever 71 and the switching rod 72 to bias the switching rod 72 to one side relative to the lever 71.

Further, the press-button cap 4 comprises a downwardly extended push rod 42 aimed at the switching rod 72 of the linkage 7, and a downwardly extended hook arm 43 aimed at the positioning rod 714 of the linkage 7. When pressing the press-button cap 4, the push rod 42 forces the switching rod 72 to reverse the lever 71, for enabling the hooked tip 431 of the hook arm 43 to hook on the positioning rod 714, so that the press-button cap 4 is held in the pressed position. The push rod 42 and the hook arm 43 may be formed integral with the press-button cap 4, or separately made and then respectively fastened to the press-button cap 4.

Figure 6:
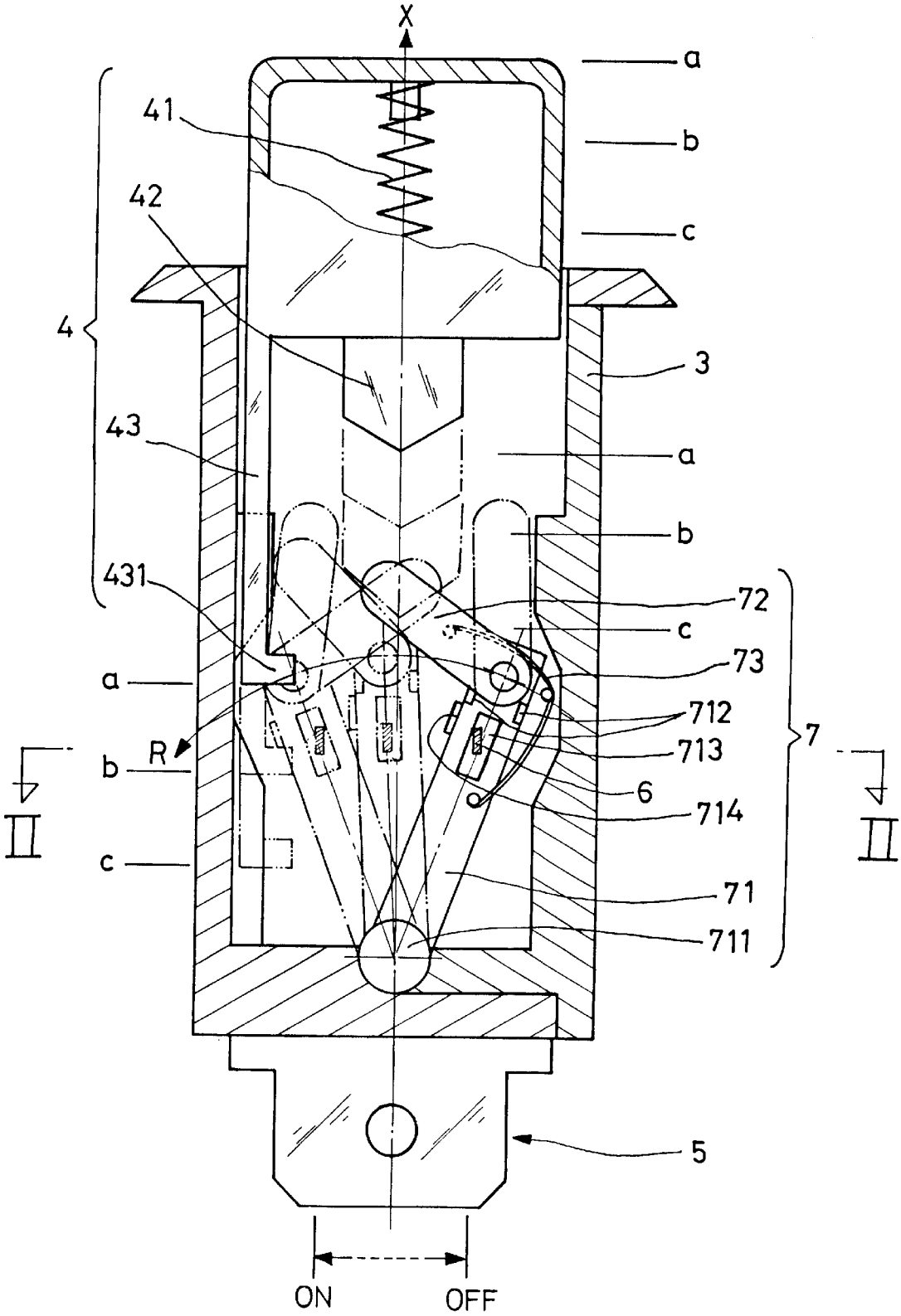
FIG. 6 is a sectional view taken along line I—I of FIG. 5.

The operation of the linkage 7 of controlling ON/OFF action of the bimetal plate 6 is outlined hereinafter with reference to FIG. 6. When pressing the press-button cap 4 downwards, the push rod 42 is lowered with the press-button cap 4 to touch the right side of the switching rod 72. Because the left side of the switching rod 72 is stopped at one stop rod 712 at this time, the switching rod 72 is prohibited from turning rightward downwards. When continuously lowering the press-button cap 4, the push rod 42 forces the switching rod 72 to turn from the right side toward the left side, thereby causing the lever 71 to turn leftward about the axis passing through the longitudinal central axis of the round rod 711 along a circular path R. When passing through the centerline X between the stop rods 712, the bimetal plate 6 is forced by its spring power to deform in the reversed direction, thereby causing the linkage 7 to be biased to the left side. When turning the linkage 7 to the left side, the switching rod 72 is forced to touch the inside wall of the housing 3 at first, and then reversed from the left side toward the right side. At this time, the spring member 73 is stretched. After the linkage 7 passed the centerline X during its return stroke (from the left side toward the right side), the spring member 73 returns to its former shape to bias the switching rod 72 to the right side. Because the switching rod 72 is stopped by the push rod 42 at this time, it cannot be moved to the set position. When releasing the press-button cap 4, the return springs 41 force the press-button cap 4 upwards to its former position, and the push rod 42 is lifted with the press-button cap 4 over the top end of the switching rod 72, for enabling the linkage 7 to shifted from the >-shaped right side position to the <-shaped left side position. By means of the aforesaid action, the safety press-button switch achieves ON/OFF switching operation.

Figure 7A:
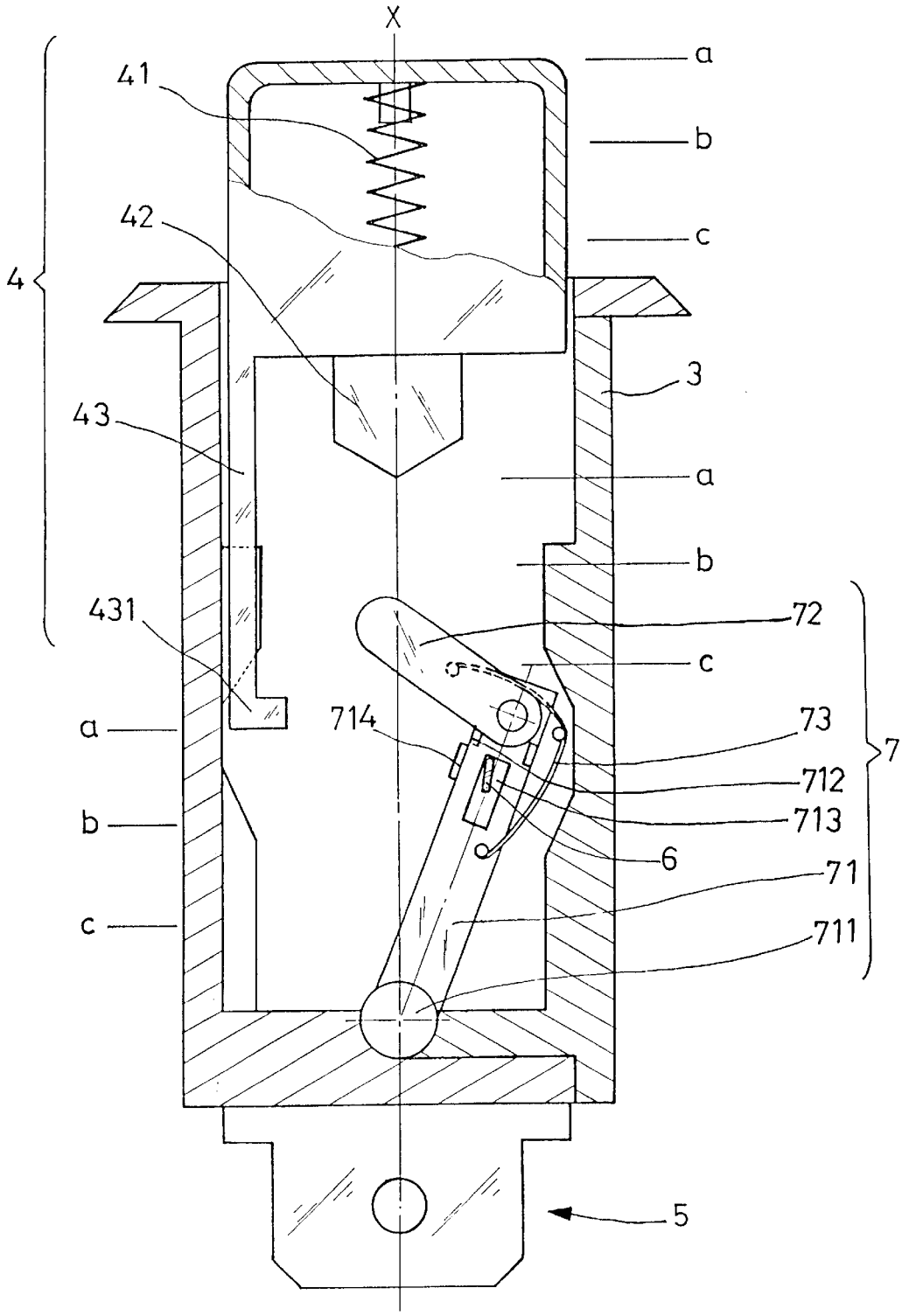
FIG. 7A shows the action of the present invention (I).

FIG. 7A shows the safety press-button switch switched to OFF position, where the return springs 41 are fully extended to support the press-button cap 4 is the upper limit position (a), the linkage 7 is set in the >-shaped right side position, the retaining portion 713 of the lever 71 holds the free end of the bimetal plate 6 in the position at the right side (see also FIG. 8), and the contact 61 of the bimetal plate 6 is spaced from the contact 51 of the second terminal 5*b*, and therefore the circuit of the safety press-button switch is OFF.

Figure 7B:
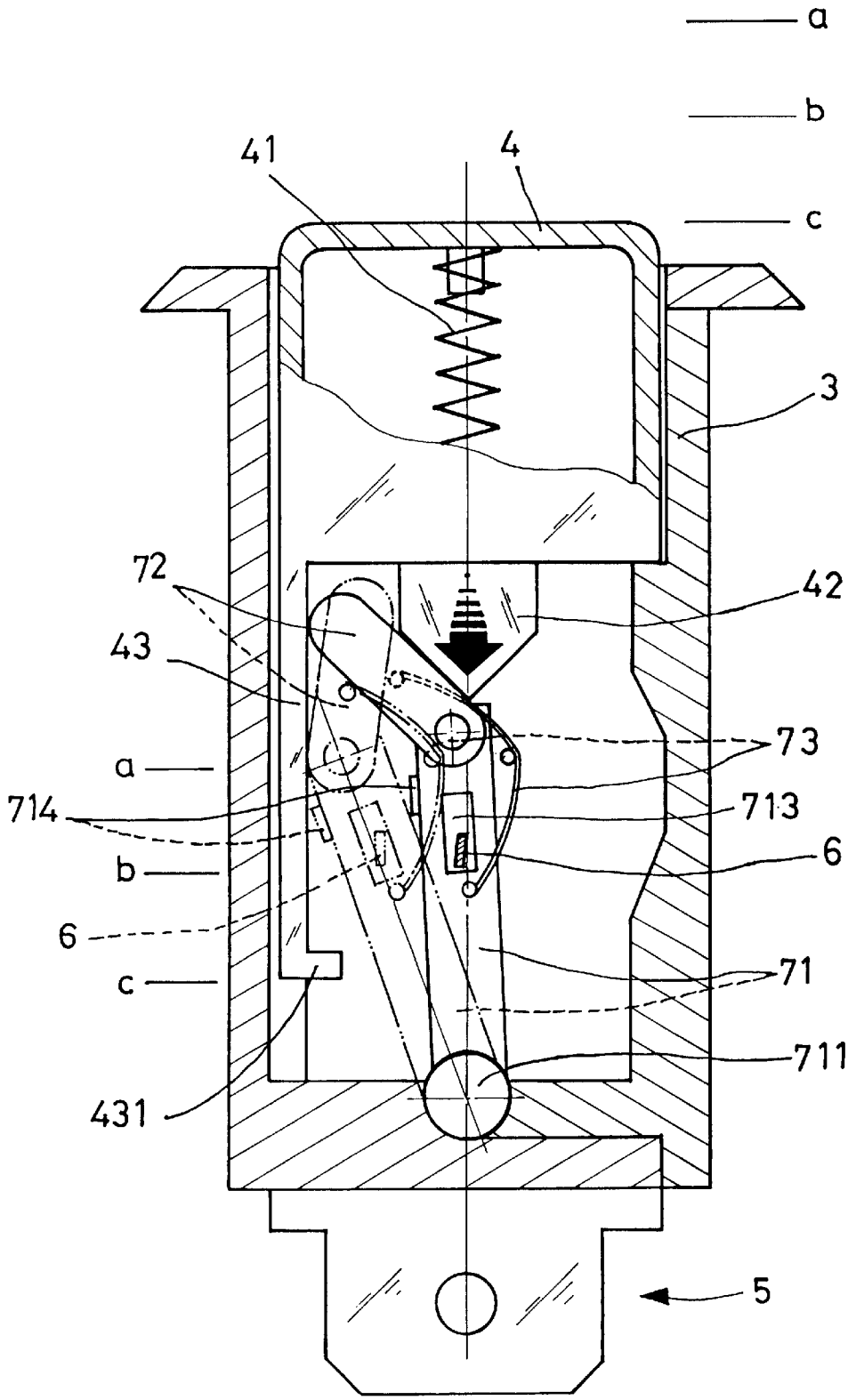
FIG. 7B shows the action of the present invention (II).

Referring to FIG. 7B, when pressing the press-button cap 4 from the upper limit position (a) to the lower limit position (c), the linkage 7 is moved over the centerline X toward the left side, and the switching rod 72 is reversed, i.e., the right side 721 of the switching rod 72 is stopped at the left side of the push rod 42, prohibiting the linkage 7 from being set into the <-shaped left side position, and at this time the hooked tip 431 is lowered with the hook arm 43 to the lower limit position (e) below the positioning rod 714 of the lever 71.

Figure 7C:
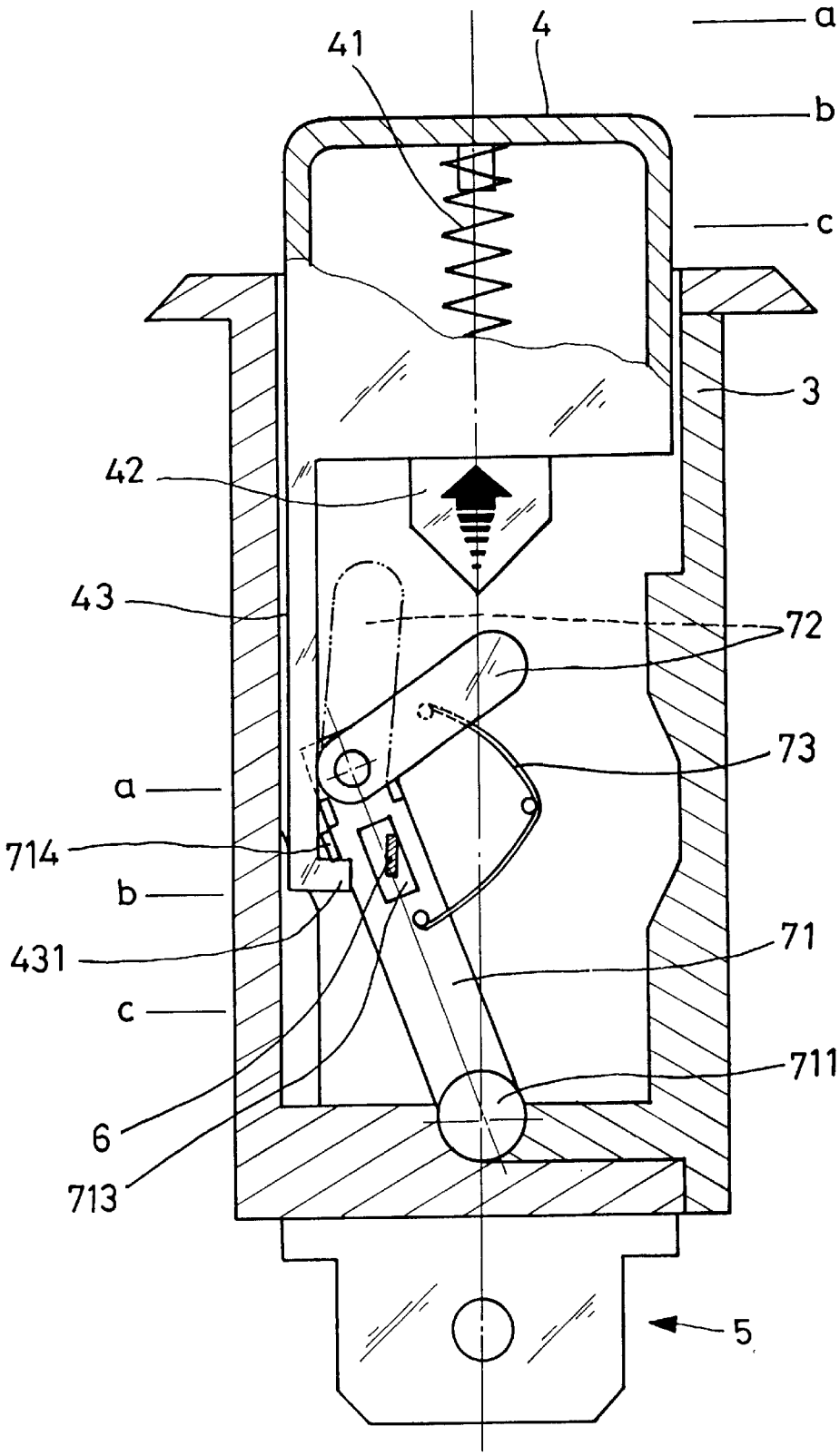
FIG. 7C shows the action of the present invention (III).

Referring to FIG. 7C, when releasing the press-button cap 4 after the hooked tip 431 lowered with the hook arm 43 to the lower limit position (e) below the positioning rod 714 of the lever 71, the return springs 41 immediately force the press-button cap 4 upwards, and at this time the hooked tip 431 is lifted with the hook arm 43 to hook on the bottom side of the positioning rod 714 and to stop the press-button cap 4 in the middle position (b) between the upper limit position (a) and the lower limit position (c). When moved to the middle position (b), the push rod 42 is released from the switching rod 72, for enabling the spring member 73 to pull the linkage 7 to the <-shaped left side position (see the dotted line shown in FIG. 8), and therefore the contact 61 of the bimetal plate 6 is forced into contact with the contact 51 of the second terminal 5*b* to close the circuit, i.e., the safety press-button switch is switched on. At this time, the positioning rod 714 of the lever 71 is hooked up with the hooked tip 431 of the hook arm 43, the press-button cap 4 is held in the middle position (b) and prohibited from being moved to the OFF position, i.e., the upper limit position (a), and the push rod 42 is spaced above the switching rod 72. In case the bimetal plate 6 is over-heated due to failure of the safety press-button switch fails or an over-current, the bimetal plate 6 automatically trips from the left side to the right side to disconnect its contact 61 from the contact 51 of the second terminal 5*b* to open the circuit and, at the same time the lever 71 is biased to the right side, and therefore the linkage 7 is shifted to the position shown in FIG. 7E (because the deformation force of the bimetal plate 6 surpasses the friction resistance between the hooked tip 431 and the positioning rod 714, the linkage 7 is smoothly turned rightwards). When shifted to the position shown in FIG. 7E, the hook arm 43 is disengaged from the positioning rod 713 of the lever 71, and the return springs 41 pushes the press-button cap 4 from the middle position (b) to the upper limit position (a). Therefore, the safety press-button switch is automatically switched off upon an overload.

Figure 7D:
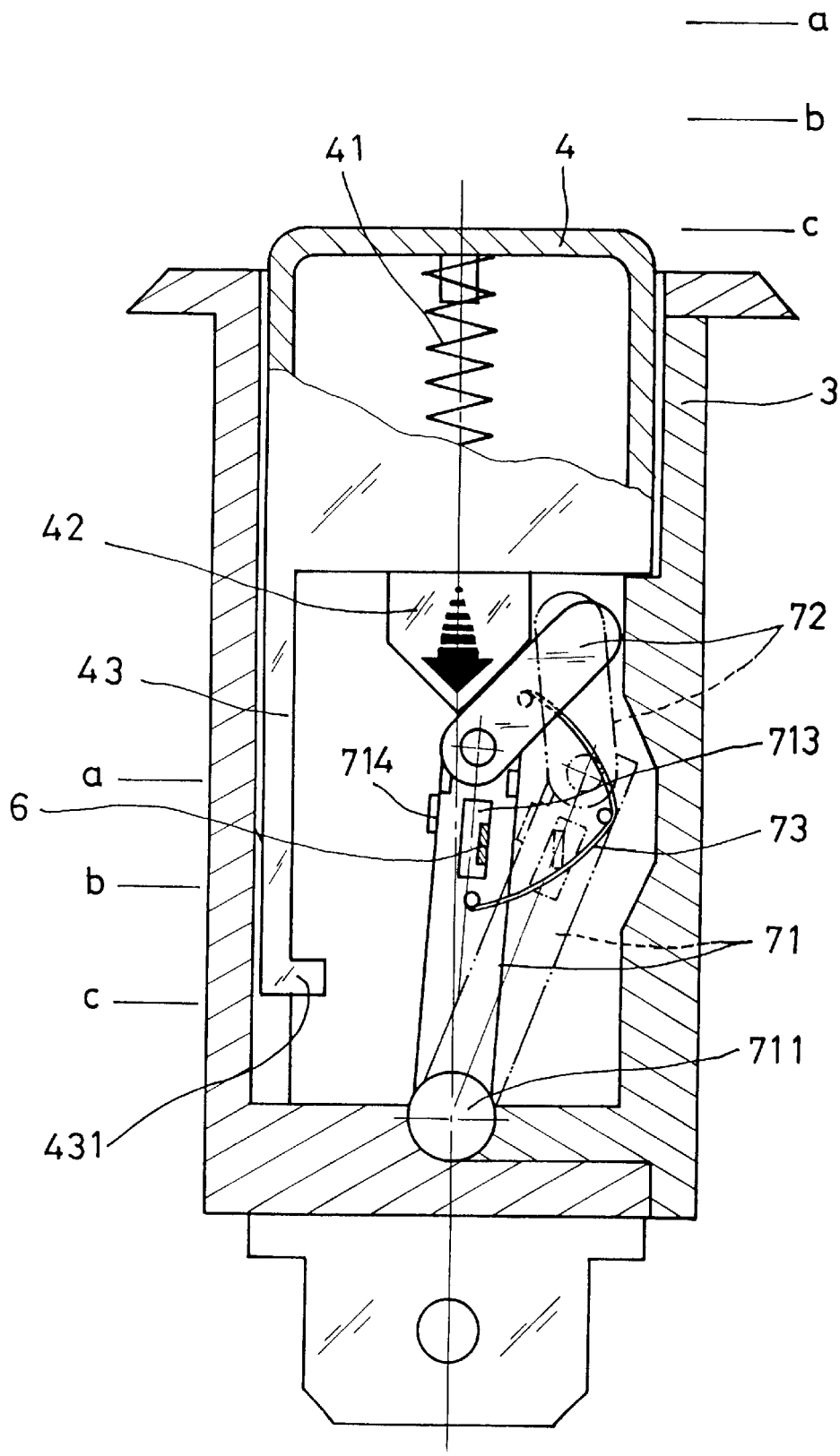
FIG. 7D shows the action of the present invention (IV).
Figure 7E:
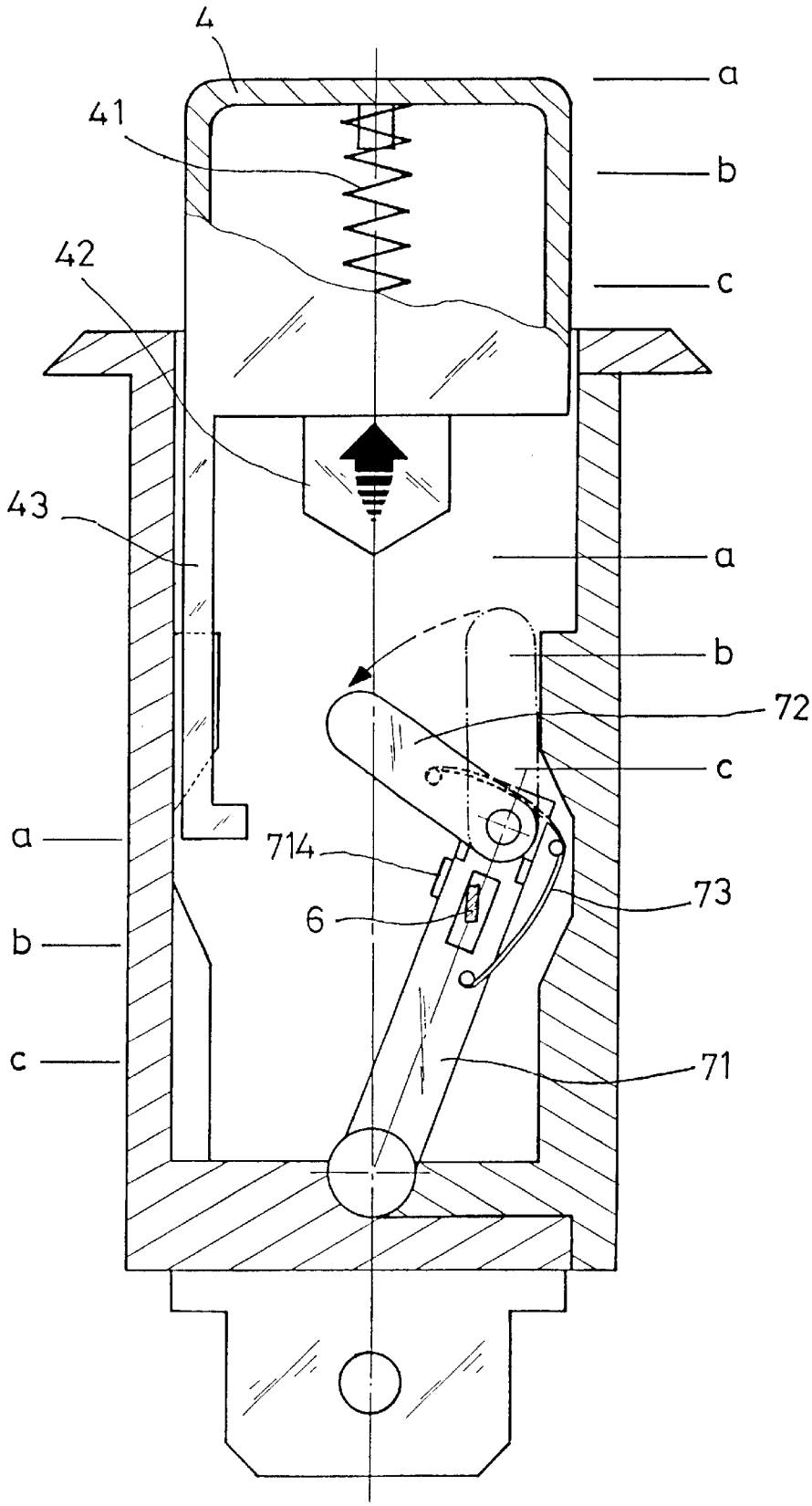
FIG. 7E shows the action of the present invention (V).

When switching the safety press-button switch from ON position to OFF position during normal use, the press-button cap 4 is lowered from the middle position (b) to the lower limit position (c), as shown in FIG. 7D. At this time, the right side of the switching lever 72 is forced by the push rod 42 in direction reversed to the direction shown in FIG. 7B, i.e., forced rightward as shown in FIG. 7E. Because the push rod 42 is disengaged from the switching rod 72 at this time, releasing the press-button cap 4 causes the return springs 41 to push the press-button cap 4 from the middle position (b) to the upper limit position (a), and the spring member 73 immediately biases the linkage 7 to the left side position, i.e., the OFF position shown in FIG. 7A. Therefore, when switching on the safety press-button switch, the switching action of the safety press-button switch proceeds subject to the order of 7A→7B→7C. On the contrary, when switching off the safety press-button switch, the switching action of the safety press-button switch proceeds subject to the order of 7C→7D→7E. By means of the use of the linkage 7 to mach the push rod 42 and hook arm 43 of the press-button cap 4, the safety press-button switch is positively switched between ON and OFF positions. Because the bimetal plate 6 is adapted to be installed in a vertical position in the housing 3, the installation of the bimetal plate 6 is easy. Further, the design of the linkage 7 enables the press-button switch to automatically trips off upon an overload.

Figure 8:
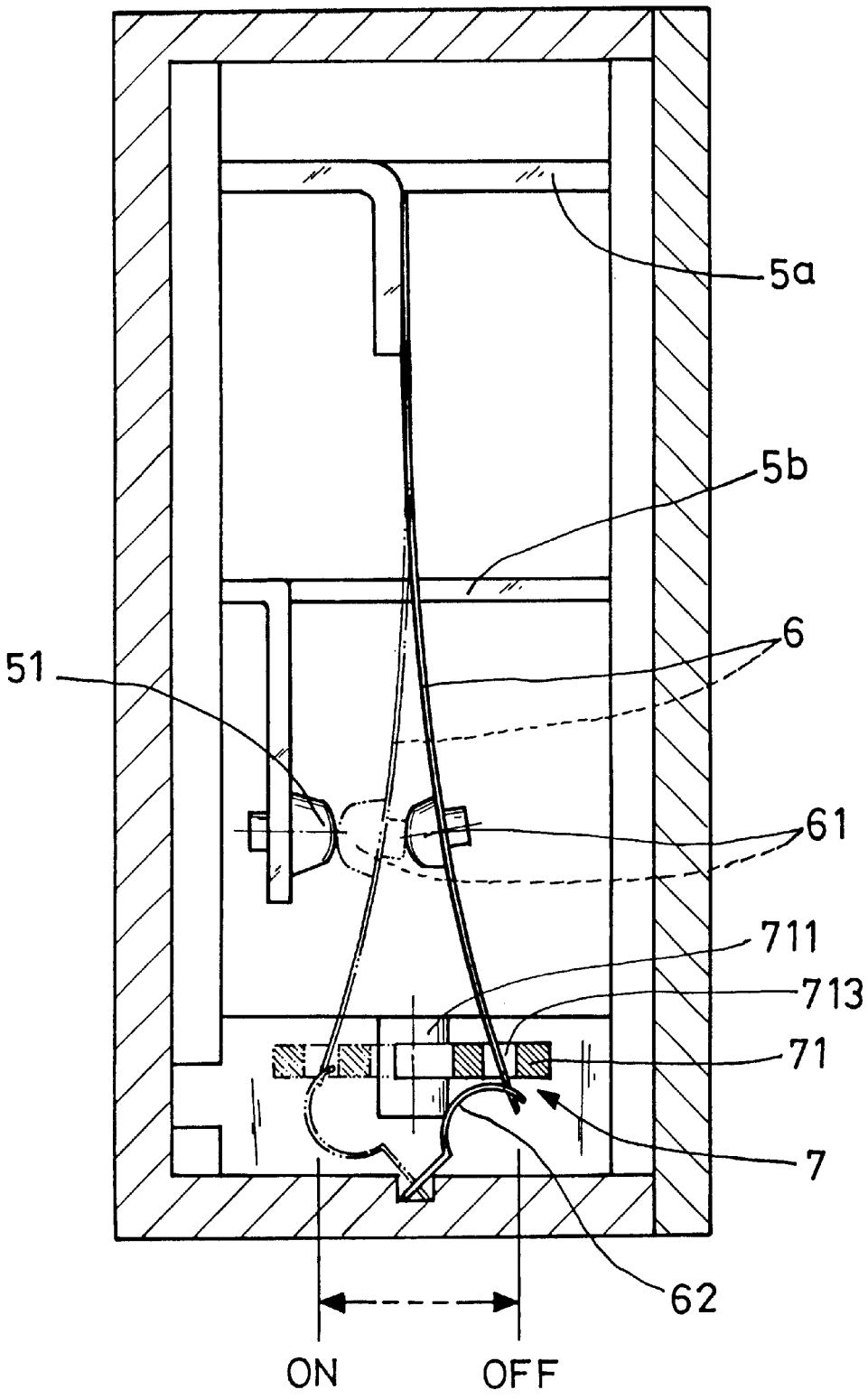
FIG. 8 is a sectional view taken along line II—II of FIG. 8.

Referring to FIG. 8. a smoothly arched spring member 62 may be installed in the housing of the safety press-button switch and connected to the free end of the bimetal plate 6 to hold the bimetal spring plate between ON and OFF positions. When deformed due to an overload, the deformation force of the bimetal plate 6 surpasses the spring power of the spring member 62, and forces the bimetal plate 6 from ON position to OFF position. This bimetal plate arrangement is seen in U.S. patent application Ser. No. 5262748, which is also an invention of the present inventor.

The application of the aforesaid linkage 7 is not limited to the use with the aforesaid bimetal plate 6. Any bimetal plate that deforms in the reversed direction when its temperature drops below or surpasses a predetermined level can be controlled by the aforesaid linkage 7 to control ON/OFF operation of the press-button switch.

A prototype of safety press-button switch has been constructed with the features of FIGS. 3~8. The safety press-button switch functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A safety press-button switch comprising a box-like electrically insulative housing;

an actuating metal contact plate mounted inside said housing, said actuating metal contact plate having a contact;

a first terminal and a second terminal mounted in said housing and respectively connected to the two opposite terminals of power supply, said first terminal being connected to said actuating metal contact plate, said second terminal having a contact facing the contact of said actuating metal contact plate;

a linkage mounted inside said housing; and a press-button cap installed in a top side of said housing for pressing by hand to drive said linkage to move said actuating metal contact plate between On and OFF positions;

wherein:

said linkage comprises a lever, said lever having a fixed bottom end pivoted to a part inside said housing, a free top end, two stop rods bilaterally disposed near said free top end, a positioning rod disposed at one side adjacent to said stop rods, and a retaining portion disposed near said free top end and equally spaced from said stop rods and secured to the free end of said actuating metal contact plate, a switching rod, said switching rod having a bottom end pivoted to the top free end of said lever and turned with said switching rod between said stop rods;

said press-button cap comprises a downwardly extended push rod and a downwardly extended hook arm respectively aimed at said switching rod of said linkage and the positioning rod of said linkage and so arranged that when pressing said press-button cap to force said actuating metal contact plate into contact with the contact of said second terminal, said push rod forces said switching rod to reverse said lever, for enabling said hook arm to hook on the positioning rod of said lever so as to hold said actuating metal contact plate in contact with the contact of said second terminal; when said actuating metal contact plate is deformed due to an overload, said lever is forced by the deformation force of said actuating metal contact plate to disengage said positioning rod from said hook arm, for enabling said actuating metal contact plate and said linkage to move away from said second terminal to switch off the safety press-button switch.

2. The safety press-button switch of claim 1 wherein said actuating metal contact plate is a bimetal plate that deforms when the temperature changes over a predetermined range.

3. The safety press-button switch of claim 2 wherein said bimetal plate is formed of two metal plates of different coefficient of temperature fastened together by stamping.

4. The safety press-button switch of claim 1 wherein said linkage further comprises a spring member connected betweens aid lever and said switching rod and adapted to bias said switching rod to one side relative to said lever.

5. The safety press-button switch of claim 1 wherein said push rod and said hook arm are formed integral with said press-button cap.

6. The safety press-button switch of claim 1 wherein said push rod and said hook arm are independent members respectively fixedly fastened to said press-button cap.

* * * * *